US009062861B2

(12) United States Patent
Hu et al.

(10) Patent No.: US 9,062,861 B2
(45) Date of Patent: Jun. 23, 2015

(54) LENS AND LIGHT SOURCE MODULE WITH SAME

(71) Applicant: HON HAI PRECISION INDUSTRY CO., LTD., New Taipei (TW)

(72) Inventors: Chau-Jin Hu, New Taipei (TW); Li-Ying Wang He, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 30 days.

(21) Appl. No.: 14/083,370

(22) Filed: Nov. 18, 2013

(65) Prior Publication Data

US 2015/0109796 A1 Apr. 23, 2015

(30) Foreign Application Priority Data

Oct. 22, 2013 (TW) ..... 102137995 A

(51) Int. Cl.

| | |
|---|---|
| ***F21V 7/00*** | (2006.01) |
| ***F21V 13/04*** | (2006.01) |
| ***F21K 99/00*** | (2010.01) |

(52) U.S. Cl.

CPC .. *F21V 13/04* (2013.01); *F21K 9/58* (2013.01)

(58) Field of Classification Search

USPC ..... 362/308, 327–329

See application file for complete search history.

(56) References Cited

U.S. PATENT DOCUMENTS

| | | | | |
|---|---|---|---|---|
| 7,084,435 | B2 * | 8/2006 | Sugimoto et al. | 257/99 |
| 2004/0190304 | A1 * | 9/2004 | Sugimoto et al. | 362/555 |
| 2012/0286314 | A1 * | 11/2012 | Shinohara et al. | 257/98 |

* cited by examiner

*Primary Examiner* — Thomas M Sember

(74) *Attorney, Agent, or Firm* — Novak Druce Connolly Bove + Quigg LLP

(57) ABSTRACT

The present disclosure relates to a lens. The lens includes a bottom surface, a light input surface, a light output surface and reflective structure. The light input surface is a curved surface depressing from a center of the bottom surface. The light output surface is opposite to the bottom surface. The light output surface includes a concave surface located at a center thereof and a convex surface located at peripheral thereof and surrounding the concave surface. The reflective structure is received in the light input surface. The reflective structure includes a plurality of globoid reflective units. The present disclosure also relates to a light source module with the lens.

12 Claims, 3 Drawing Sheets

LENS AND LIGHT SOURCE MODULE WITH SAME

BACKGROUND

1. Technical Field

The disclosure relates to a lens and a light source module with the lens.

2. Discussion of Related Art

Light emitting diodes' (LEDs) many advantages, such as high luminosity, low operational voltage, low power consumption, compatibility with integrated circuits, easy driving, long term reliability, and environmental friendliness have promoted their wide use as a lighting source.

However, the conventional LED illumination apparatus generally has a radiation angle about 120 degrees and generates a butterfly-type light field. The intensity of light emitted by the LED illumination apparatus dramatically decreases when the radiation angle exceeds 120 degrees.

Therefore, what is needed is a lens and a light source module with the lens which can overcome the described limitations.

BRIEF DESCRIPTION OF THE DRAWINGS

Many aspects of the disclosure can be better understood with reference to the following drawing. The components in the drawing are not necessarily drawn to scale, the emphasis instead being placed upon clearly illustrating the principles of the present the lens and the light source module for micro-miniaturization. Moreover, in the drawing, like reference numerals designate corresponding parts throughout the whole view.

DETAILED DESCRIPTION OF EMBODIMENTS

Figure 1:
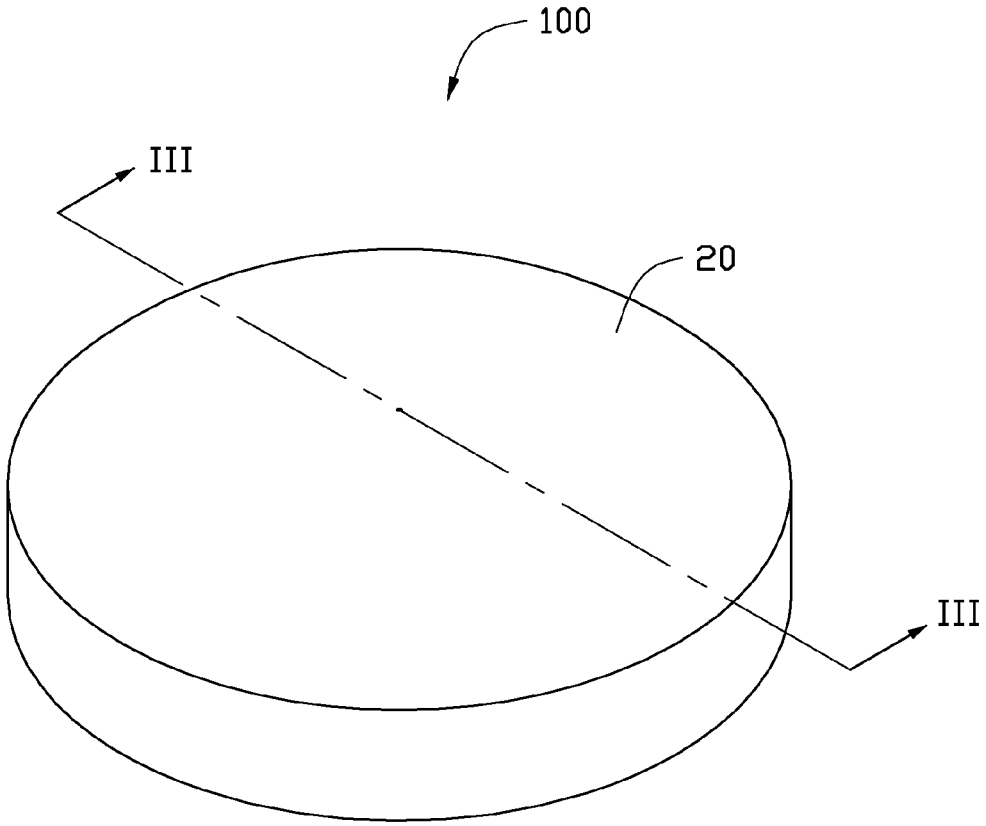
FIG. 1 is a schematic, isometric view of a light source module according to an exemplary embodiment of the present disclosure.
Figure 2:
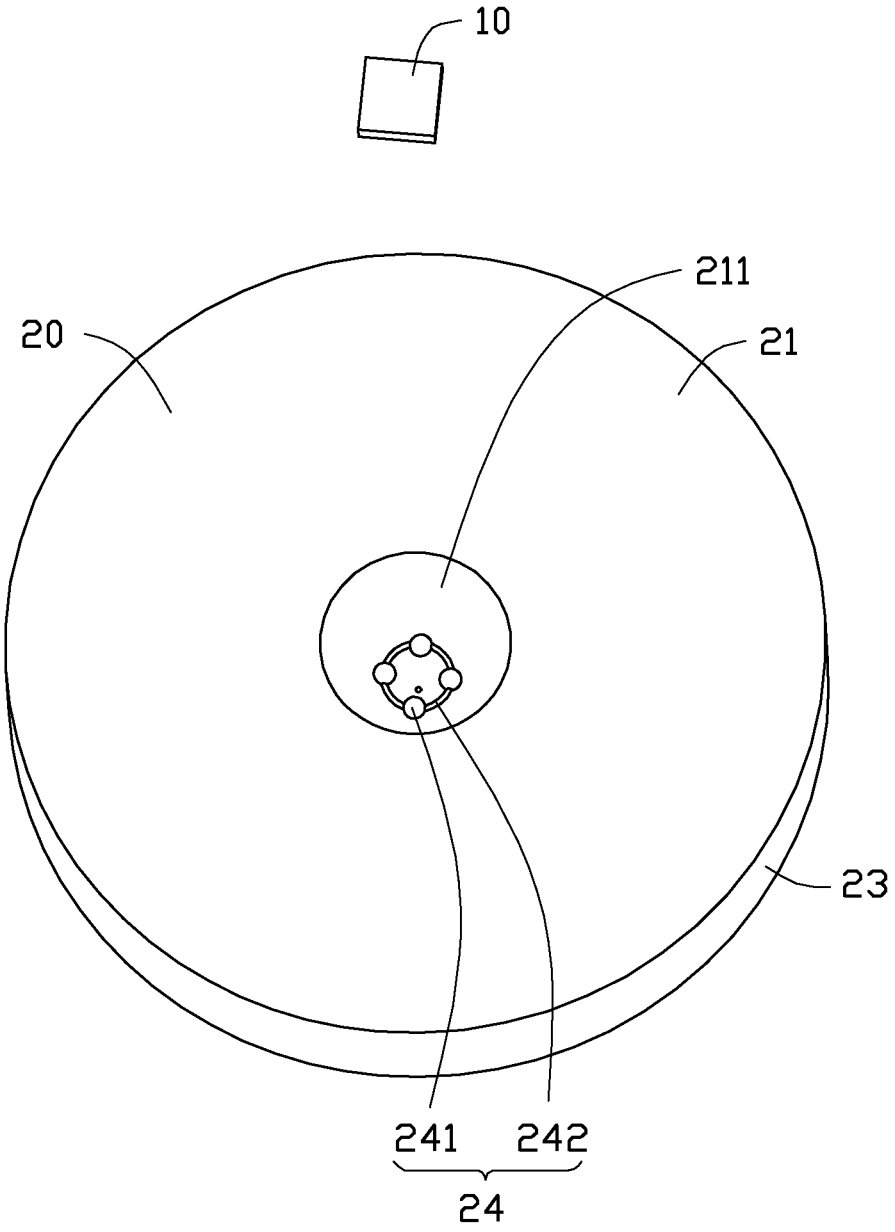
FIG. 2 is an inverted, disassembled view of the light source module of FIG. 2.

Referring to FIGS. 1 and 2, a light source module 100 in accordance with an exemplary embodiment of the present disclosure is illustrated. The light source module 100 includes a light source 10 and a lens 20. Light emitted from the light source 10 is adjusted by the lens 20.

Figure 3:
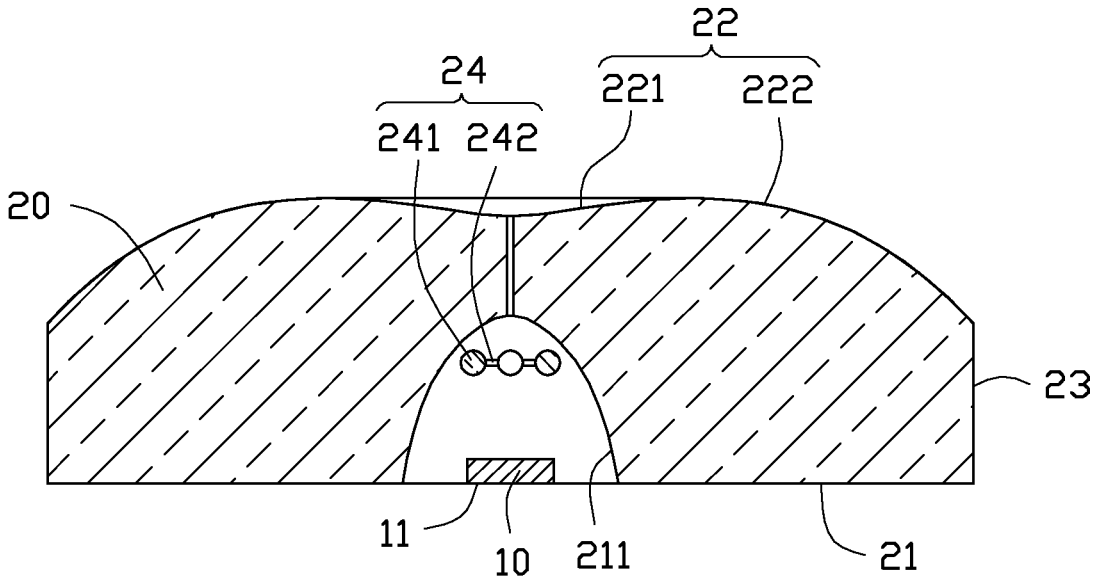
FIG. 3 is a cross-sectional view of the light source module of FIG. 1, taken along line III-III thereof.

Referring to FIG. 3 also, the lens 20 includes a bottom surface 21, a light input surface 211, a light output surface 22, a side surface 23 and a reflective structure 24 below the light input surface 211.

The bottom surface 21 is a planar circular surface. The light input surface 211 is a curved surface depressing from a center of the bottom surface 21 towards the light output surface 22 of the lens 20. The light input surface 211 defines a cavity. In the present embodiment, a central axis of the light input surface 211 is coaxial to that of the lens 20. The light input surface 211 is substantially elliptical, and a short axis of the elliptical light input surface 211 is substantially coplanar with the bottom surface 21, and a long axis of the elliptical light input surface 211 is perpendicular to the bottom surface 21.

The light output surface 22 is opposite to the bottom surface 21. The light output surface 22 is an aspheric surface and includes a concave surface 221 located at a center thereof and a convex surface 222 located at peripheral thereof and surrounding the concave surface 221. The concave surface 221 is just opposite to the light input surface 211 and is depressed towards the light input surface 211 of the lens 20. The concave surface 222 is used for diverging direct light (i.e., light having a small emerging angle) emitted from the light source 10. The convex surface 222 smoothly connects the concave surface 221 and is used for diverging side light (i.e., light having a large emerging angle) emitted from the light source 10.

The side surface 23 connects the bottom surface 21 and the light output surface 22. In the present embodiment, the side surface 23 is perpendicular to the bottom surface 21. The first side surface 23 is substantially cylindrical.

The reflective structure 24 is received in the cavity defined by the light input surface 211. The reflective structure 24 includes a plurality of globoid reflective units 241 evenly distributed and a plurality of tubes 242. The globoid reflective units 241 are interconnected via the tubes 242. In the present embodiment, the reflective structure 24 includes four globoid reflective units 241 and four tubes 242. The four globoid reflective units 241 are evenly arranged in a circle which parallel to the bottom surface 21, and a central axis of the circle is coaxial to that of the lens 20. The globoid reflective units 241 are made of high reflective material, such as metal. The tube 242 can be made of polymethyl methacrylate (PMMA). The reflective structure 24 can be fixed in the cavity defined by the light input surface 211 via a cord which extending through the lens 20.

The light source 10 faces the light input surface 211 of the lens 20 and is received in the cavity defined by the light input surface 211. In the present embodiment, a bottom surface of the light source 11 is coplanar with the bottom surface 21 of the first lens 20. The light source 10 is an LED, and a central axis of the LED is coaxial to that of the lens 20.

Part of the light beams emitted from the light source 10 are reflected and diverged by the reflective structure 24 to different directions, and then enter the lens 20 via the light input surface 211. The other parts of light beams emitted from the light source 10 are directly enters the lens 20 via the light input surface 211. All light beams are refracted and diverged by the concave surface 221 and the convex surface 222 of the lens 20 to radiate to the outside environment; therefore, the light emission of the light source module 100 can be substantially evenly distributed.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. A lens comprising:

a bottom surface;

a light input surface being a curved surface depressing from a center of the bottom surface;

a light output surface opposite to the bottom surface, the light output surface comprising a concave surface located at a center thereof and a convex surface located at a peripheral thereof and surrounding the concave surface; and a reflective structure received in a cavity defined by the light input surface, the reflective structure comprising a plurality of globoid reflective units.

2. The lens of claim 1, wherein the reflective structure further comprises a plurality of tubes, the globoid reflective units are interconnected to form a circle via the tubes.

3. The lens of claim 2, wherein a central axis of the circle is coaxial to that of the lens.

4. The lens of claim 1, wherein the globoid reflective units are evenly distributed.

5. The lens of claim 1, wherein the bottom surface of the lens is a planar circular surface.

6. The lens of claim 1, further comprising a side surface connected to the bottom surface and the light output surface, the side surface being perpendicular to the bottom surface.

7. The lens of claim 1, wherein the first light input surface is an elliptic sphere surface.

8. The lens of claim 1, wherein a central axis of the light input surface is coaxial to that of the lens.

9. A light source module comprising a lens and a light source facing the lens, the lens comprising:

a bottom surface;

a light input surface being a curved surface depressing from a center of the bottom surface, the light source facing the light input surface;

a light output surface opposite to the bottom surface, the light output surface comprising a concave surface located at a center thereof and a convex surface located at a peripheral thereof and surrounding the concave surface; and a reflective structure received in a cavity defined by the light input surface, the reflective structure comprising a plurality of globoid reflective units.

10. The light source module of claim 9, wherein the light source is an LED, and a central axis of the LED is coaxial to that of the lens.

11. The light source module of claim 9, wherein the light input surface is an elliptic sphere surface.

12. The light source module of claim 9, wherein a central axis of the light input surface of the lens is coaxial to that of the lens.

* * * * *